US011225816B2

(12) United States Patent
Gayhart

(10) Patent No.: US 11,225,816 B2
(45) Date of Patent: Jan. 18, 2022

(54) SLIDING SECURITY DOOR WITH PASSIVE DEADLOCK PREVENTION

(71) Applicant: Hydra DoorCo LLC, Racine, WI (US)

(72) Inventor: Gary Gayhart, Racine, WI (US)

(73) Assignee: Hydra DoorCo LLC, Racine, WI (US)

( * ) Notice: Subject to any disclaimer, the term of this patent is extended or adjusted under 35 U.S.C. 154(b) by 226 days.

(21) Appl. No.: 16/695,477

(22) Filed: Nov. 26, 2019

(65) Prior Publication Data

US 2021/0156184 A1 May 27, 2021

(51) Int. Cl.

| | |
|---|---|
| ***E05D 15/06*** | (2006.01) |
| ***E05B 65/00*** | (2006.01) |
| ***E05C 9/02*** | (2006.01) |
| ***E06B 3/46*** | (2006.01) |

(52) U.S. Cl.

CPC ..... *E05D 15/0643* (2013.01); *E05B 65/0017* (2013.01); *E05C 9/02* (2013.01); *E05D 15/0626* (2013.01); *E05D 15/0647* (2013.01); *E06B 3/4636* (2013.01); *E05Y 2900/132* (2013.01)

(58) Field of Classification Search

USPC ..... 49/360, 362

See application file for complete search history.

(56) References Cited

U.S. PATENT DOCUMENTS

| | | | | |
|---|---|---|---|---|
| 5,241,787 A * | 9/1993 | Norman | E05B 65/0017 | 49/16 |
| 8,959,836 B2 * | 2/2015 | Gayhart | E05F 15/56 | 49/141 |
| 2006/0137252 A1 * | 6/2006 | Kriese | E05F 15/40 | 49/360 |
| 2015/0047150 A1 * | 2/2015 | Saito | E05F 1/16 | 16/103 |

FOREIGN PATENT DOCUMENTS

| | | | | |
|---|---|---|---|---|
| GB | 791063 A * | 2/1958 | E06B 3/4636 | |
| GB | 1181667 A * | 2/1970 | E06B 3/4636 | |

* cited by examiner

*Primary Examiner* — Marcus Menezes
(74) *Attorney, Agent, or Firm* — Jansson Munger McKinley & Kirby Ltd.

(57) ABSTRACT

In a high-security sliding-door apparatus for closing and opening a corridor, the door having (a) a door frame having a track and a bi-directional effector, (b) a carriage having track-engaging rollers, (c) a slide plate slidably secured to the carriage and driven by the effector, and (d) a controller controlling slide-plate movement and enabling the door to be continuously closed but not locked, the improvement comprising centering apparatus for relative positioning of the slide plate and carriage, the centering apparatus including (1) a yoke attached to the slide plate at a yoke pivot and having a yoke cam surface thereabove, (2) a carriage-attached yoke-cam follower, and (3) springs having proximal ends attached to the yoke spaced above the yoke pivot and distal ends each attached to the carriage at points offset from the yoke pivot in opposite lateral directions, centering the door with the slide plate when unlocked.

7 Claims, 13 Drawing Sheets

SLIDING SECURITY DOOR WITH PASSIVE DEADLOCK PREVENTION

FIELD OF THE INVENTION

This invention relates generally to sliding doors and, more particularly, to sliding doors which may be used in facilities in which both high security and safety are important requirements of the intended performance of the doors.

BACKGROUND OF THE INVENTION

High-security door devices which slide between an open and a closed position and which are used in detention or military facilities are well known in the art. Such doors are regulated by various code requirements. The National Fire Protection Association ("NFPA") mandates that under an emergency condition, doors shall not relock, i.e., must prevent deadlock upon closing. (NFPA Life Safety Code, Section 101.) NFPA section 80 states that if a door has a self-closing feature achieved by powered operation, the door shall be capable of performing the self-closing feature for a minimum of 50 cycles when power service is lost.

Correction facilities have long been in need of a detention sliding-door device which meets the operational requirements of both life and fire-safety as mandated by code. In general, sliding doors installed in these buildings are used to control access within detention or military facilities along the paths of ingress and egress from and within these facilities. A most significant shortcoming of such sliding doors has been meeting the life safety requirement for emergency egress from buildings. Recently, however, U.S. Pat. No. 8,959,836 (Gayhart, herein "the '836 patent") has disclosed a sliding security door which meets the above-outlined requirements of the National Fire Protection Association. The '836 patent in its entirety is incorporated herein by reference.

The sliding security door device disclosed in the '836 patent operates primarily as a corridor sliding-door device with substantial improvements over the devices of the prior art. When placed into the emergency mode, the device disclosed in the '836 patent prevents a deadlocked condition in either the open or closed unlocked positions. The door is powered to close, and the door is able to be opened by manually overriding the closing force of the door. When released, the door moves to a fully-closed position but remains unlocked. The device is a "life safety" sliding-door device that allows for egress when closed but unlocked. The door structure itself may provide a fire rating to meet various code requirements.

The invention disclosed herein involves an improvement to the door of the '836 patent, incorporating novel deadlock prevention apparatus which is entirely passive (unpowered). Deadlock prevention in the disclosure of the '836 patent is accomplished using a pair of solenoids controlled by the controller of the door system to prevent movement of the slide bar into a locked position. Engineering sensibility and experience with correctional facility operation point to potential wear-and-tear and timing issues related to such an approach to deadlock prevention. Thus there is a need for an entirely unpowered approach to deadlock prevention, thereby increasing reliability and preventing possible purposeful damage to the deadlock-prevention system.

SUMMARY OF THE INVENTION

This invention is an improved sliding-door apparatus for closing and opening a passage in a wall. The high-security sliding-door apparatus has: (a) a door frame having a door-supporting track and a bi-directional effector, (b) a carriage secured to a door top edge and having track-engaging rollers; (c) a slide plate (i) slidably secured to the carriage, (ii) driven by the effector, and (iii) having two end sections, and (d) a controller controlling slide-plate movement and configured to enable the door to be continuously closed but not locked when a continuously-closed signal is received by the controller. The improvement comprises mechanical centering apparatus for relative positioning of the slide plate and carriage. The centering apparatus includes: (1) a yoke pivotably attached to the slide plate at a yoke pivot and having a yoke cam surface thereabove; (2) a yoke-cam follower attached to the carriage and following the cam surface; and (3) a pair of springs having proximal ends attached to the yoke spaced above the yoke pivot and distal ends each attached to the carriage at points offset from the yoke pivot in opposite lateral directions. The mechanical centering apparatus keeps the door substantially centered on the slide plate unless a slide-plate end section is driven to a locked-open or locked-closed position.

In preferred embodiments, the controller is a programmable electronic controller. Also in some preferred embodiments, the effector is an electric motor, and the slide plate includes a rack driven by a pinion on the motor.

Some highly-preferred embodiments include a position sensor for sensing position of the slide plate relative to the frame. In some of these embodiments, (a) the slide plate includes a cam slot parallel to the direction of the door opening and closing movement and spanning the slide plate between the two end sections, the cam slot having a slot end in each of the end sections, the slot ends each including an end portion positioned below a spanning portion of the cam slot and a ramp portion connecting each end portion with its corresponding ramp portion such that the cam slot is a continuous slot between the two end portions, (b) a vertical lock bar is slidably secured to the frame and has an upper end, a lower end, and a cam follower secured to the upper end of the lock bar and configured to engage the cam slot; and (c) the sliding-door apparatus includes a lower-locked-open notch and a lower-locked-closed notch both fixed with respect to the door and configured such that the lower-locked-open notch receives the lower end of the lock bar when the door is in the locked-open position and the lower-locked-closed notch receives the lower end of the lock bar when the door is in the locked-closed position. Also, some of these embodiments include an upper-locked-open notch and an upper-locked-closed notch both fixed with respect to the door and configured such that the upper-locked-open notch receives the upper end of the lock bar when the door is in the locked-open position and the upper-locked-closed notch receives the upper end of the lock bar when the door is in the locked-closed position.

The term "substantially centered" as used herein refers to the relative alignment of two objects (herein a slide plate and carriage/door) being kept at or very near a preset relative position during a period of operation. The word "centered" as used in the term "substantially centered" does not imply that the alignment is of a geometric center of one or both of the slide plate and carriage/door but merely a preset relative position thereof. Deviations from precise relative alignment occur due to inertia and spring forces overcoming such inertia as the slide plate and carriage/door move along the door frame. The word "substantially" as used in the term "substantially-centered" is not used to simply mean "about"

or "approximately," but is used with respect to the dynamic performance of the structure as limited by the nature of the inventive structure.

The term "deadlock" (or "deadlocked") as used herein refers to a state of the door when it is locked, either in a closed or open position. Such term as used herein is completely interchangeable with the term "lock" (or "locked") since deadlock is a term in the art in the relevant industry.

The term "continuously-closed" as used herein refers to an operational state of a door in which a door is unlocked and when not held open, the door will close and remain closed until opened manually. Such operation occurs during emergency operation.

The term "continuously-closed signal" as used herein refers to a control signal (sent to the controller) which is used to set the state of a door to operate in a continuously-closed manner. For example, a continuously-closed signal may be sent to a sliding-door apparatus as part of response to a fire alarm.

The term "controller" as used herein refers to any of a number of types of apparatus which are capable of providing actuation signals based on the position of objects and designed-in logic functions. These devices may be but are not limited to devices which are electrical, electronic or pneumatic. Such control devices and systems are well known in the art.

BRIEF DESCRIPTION OF THE DRAWINGS

FIG. 8 illustrates the sliding-door mechanism of FIG. 7 with the door in an unlocked-closed position during emergency operation.

FIG. 9 illustrates the sliding-door mechanism of FIG. 7 with the door in an unlocked-open position during emergency operation.

FIG. 10 illustrates the sliding-door mechanism of FIG. 7 with the door in a locked-closed position during normal operation.

FIG. 11 illustrates the sliding-door mechanism of FIG. 7 with the door in a locked-open position during normal operation.

DETAILED DESCRIPTION OF PREFERRED EMBODIMENTS

Figure 1:
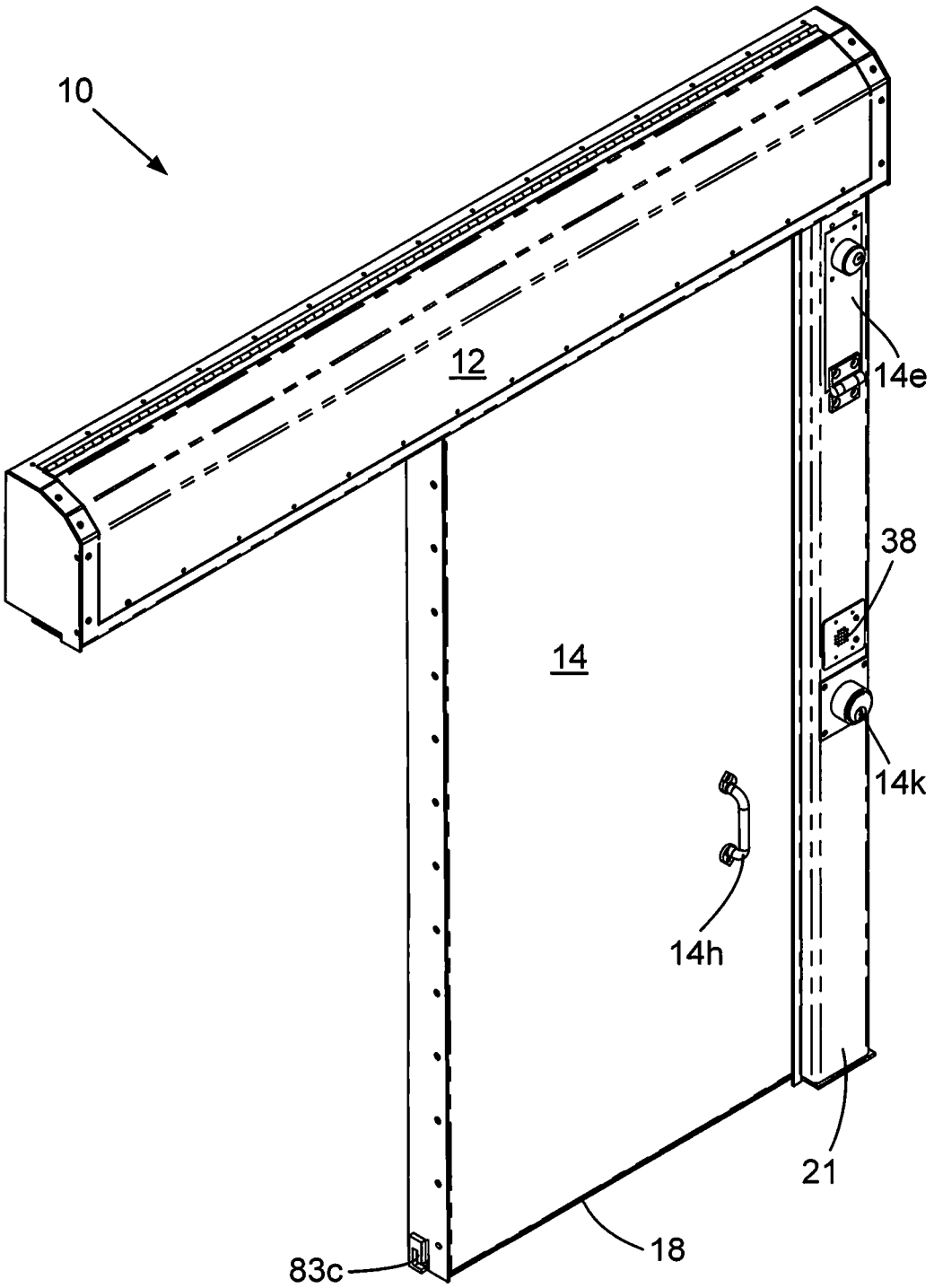
FIG. 1 is a front-view perspective drawing of an embodiment of the sliding-door apparatus of this invention with the door in a closed position.
Figure 2:
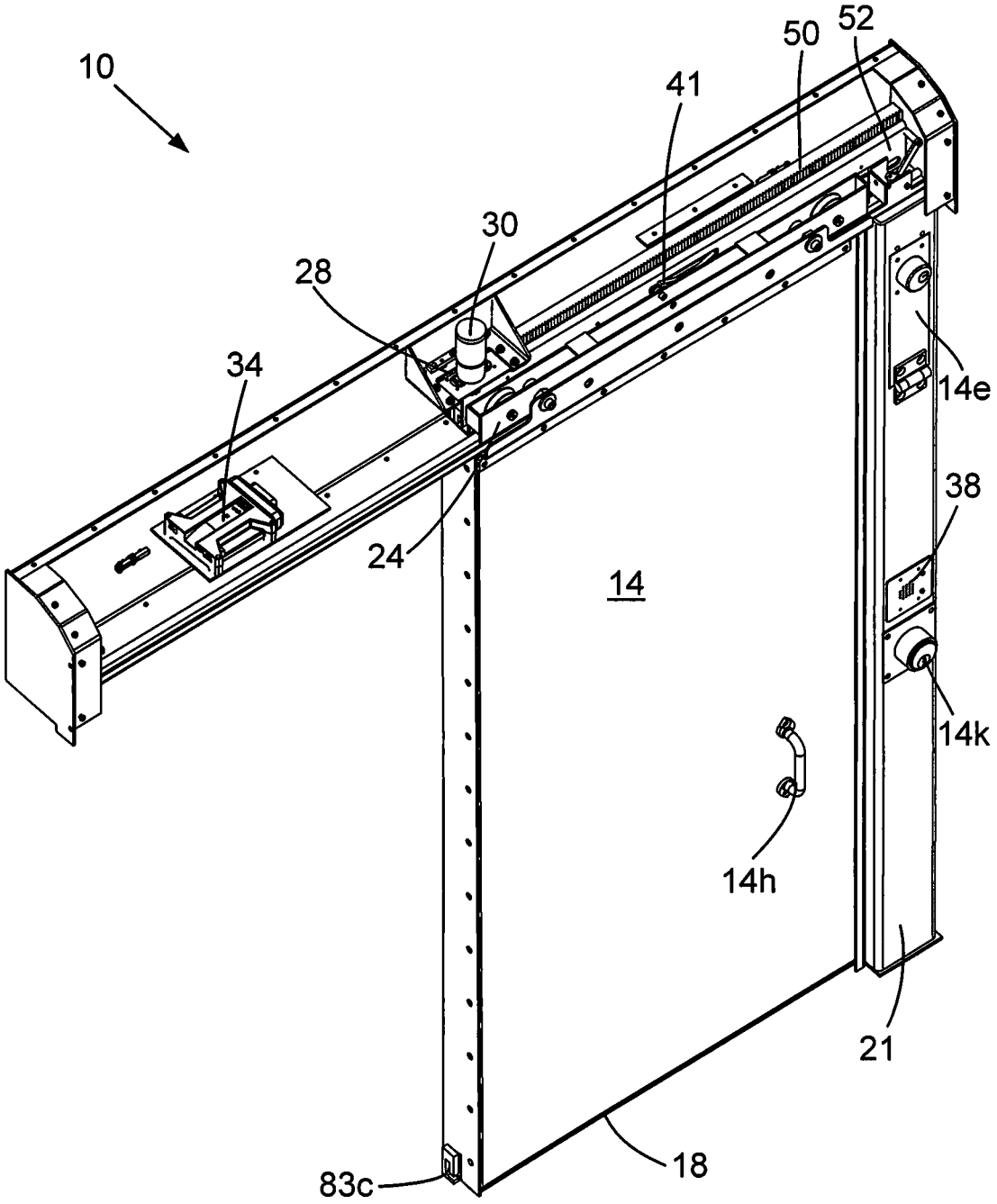
FIG. 2 is a front-view perspective drawing of the sliding-door embodiment of FIG. 1 with the cover removed from the upper portion of the apparatus to show portions of the sliding-door mechanism.
Figure 3:
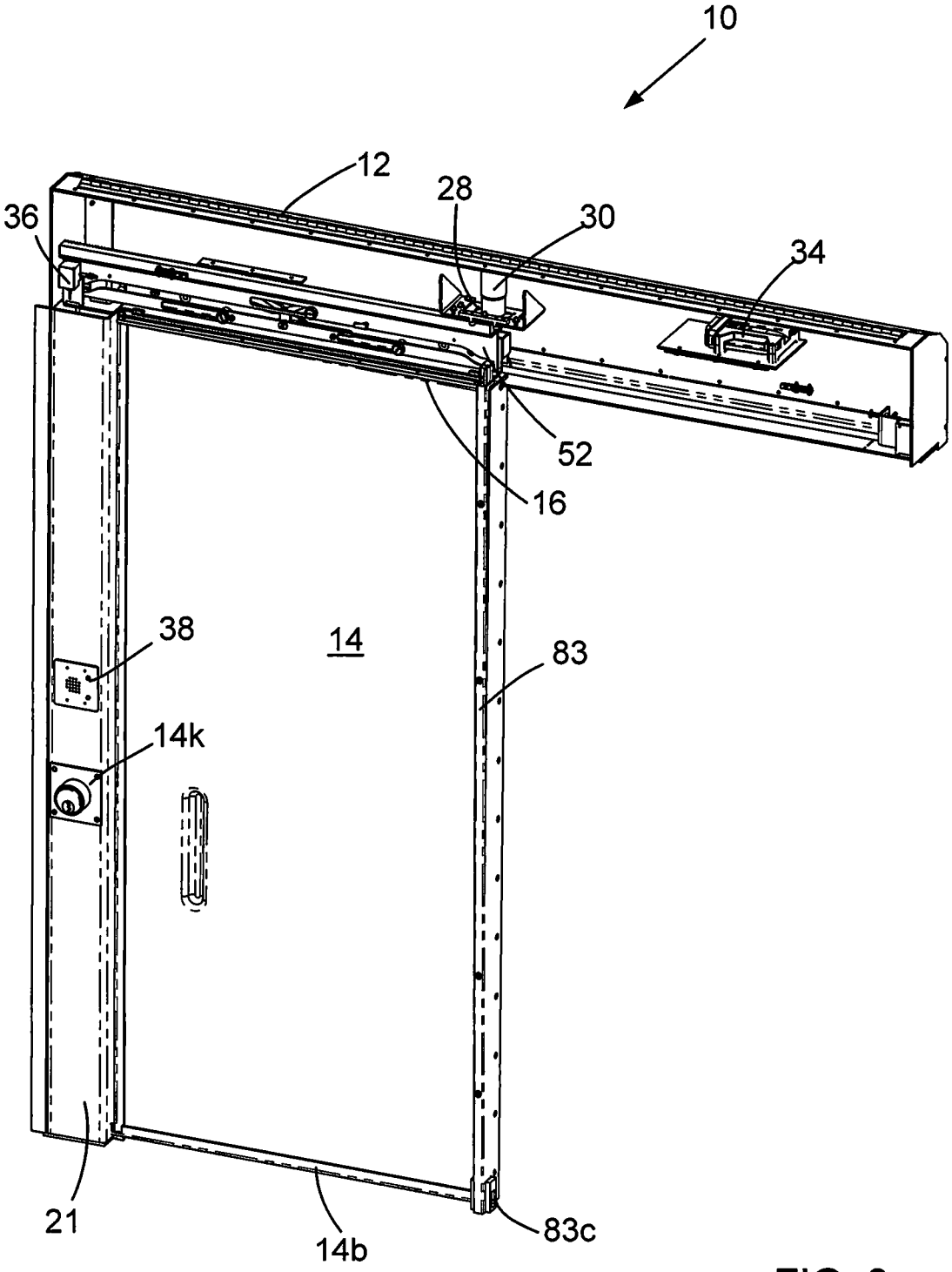
FIG. 3 is a rear-view perspective drawing of the sliding-door embodiment of FIG. 1 with the cover removed from the upper portion of the apparatus to show portions of the sliding-door mechanism.
Figure 4A:
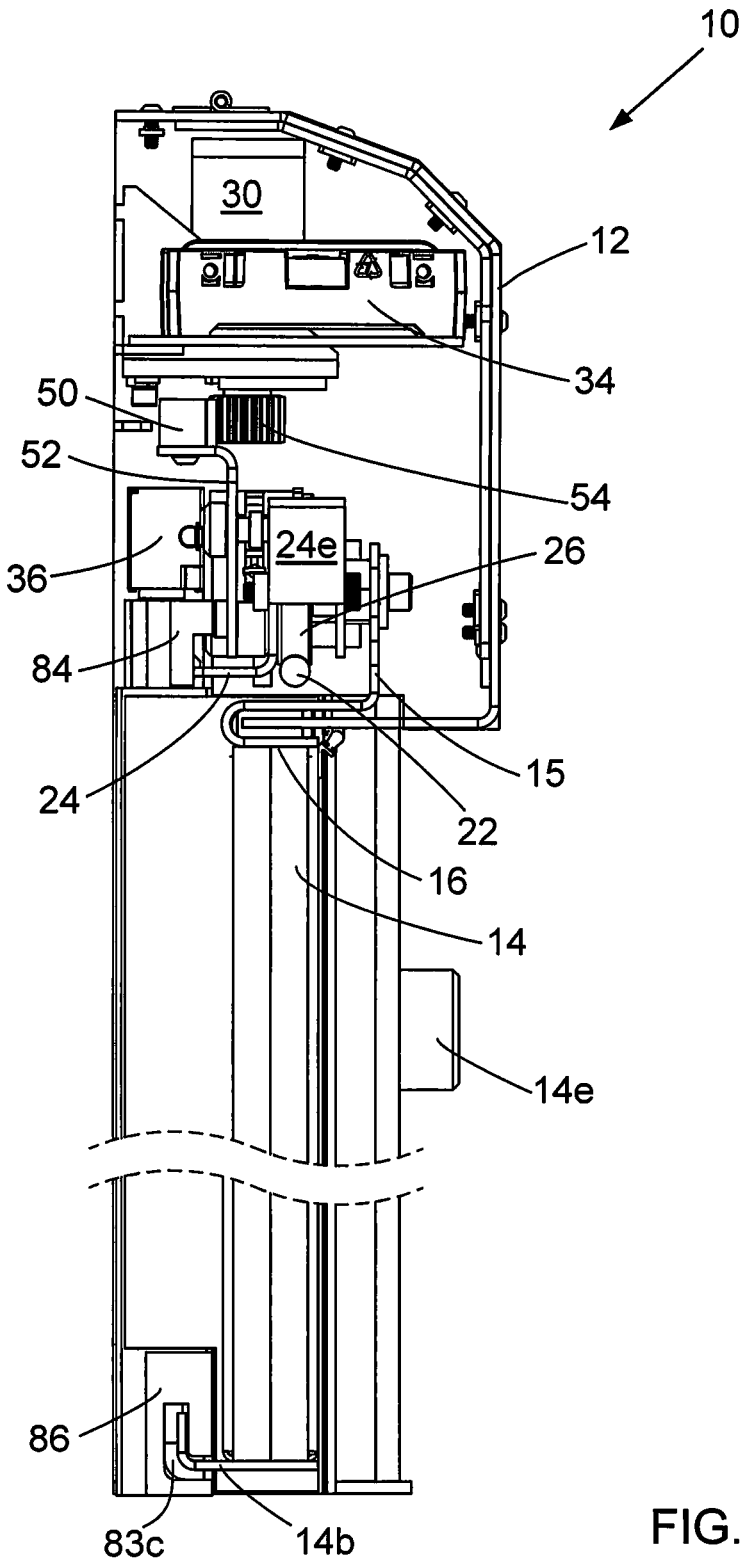
FIG. 4A is an end-view cutaway drawing of portions of the mechanism of the sliding-door embodiment of FIG. 1.
Figure 4B:
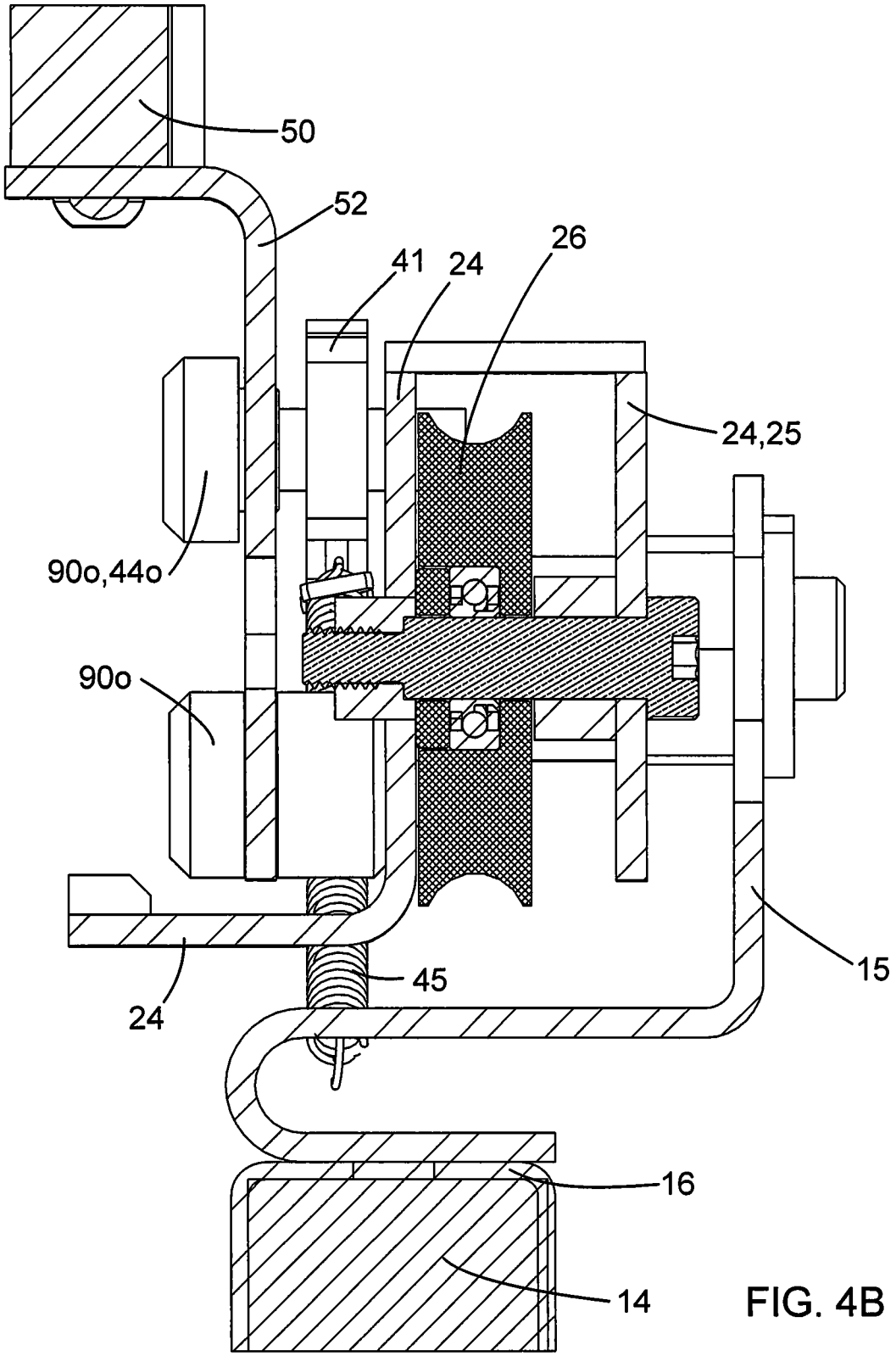
FIG. 4B is a partial end-view cross-sectional drawing of portions of the mechanism of the sliding-door embodiment of FIG. 1.

FIGS. 1 through 4B illustrate a sliding-door apparatus 10 (also referred to as embodiment 10) for closing and opening a barrier (such as a door 14) in a wall (not shown). FIGS. 2 and 3 include views of sliding-door apparatus 10 for the front and back, respectively, with certain portions of its internal mechanism showing. FIGS. 4A and 4B are end views showing more clearly certain components of the internal mechanism of sliding-door apparatus 10. Not all components are labeled in every figure in which they are visible, and for additional clarity, not every component is illustrated in every figure. In some figures, dotted lines represent hidden component parts.

As shown in FIGS. 1 through 4B, sliding-door apparatus 10 includes sliding door 14 having a top edge 16 and a bottom edge 18, a door frame 20 having a track 22 adjacent to top edge 16 of door 14. (In embodiment 10, track 22 is a rail having a circular cross-section. See FIG. 4A.) A carriage 24 is secured to top edge 16 of door 14 and has track-engaging rollers 26 and a drive mechanism 28 for opening and closing movement of door 14. Carriage 24 includes two carriage ends 24*e* and a carriage front 25 (see FIG. 5). Door 14 is hung on carriage 24 by a door hanger 15.

Drive mechanism 28 includes a bi-directional effector 30 (in embodiment 10, an electric motor, also 30) secured with respect to frame 20 and driving door 14 via a slide plate 52. Slide plate 52 is slidably secured to carriage 24 and driven through a pinion 54 of effector 30 which engages a rack 50 attached to slide plate 52. Sliding-door apparatus 10 also include a cover 12 as shown at least in FIGS. 1 and 4A; cover 12 is removed from sliding-door apparatus 10 in FIG. 2.

Sliding-door apparatus 10 is connected to a power-storing power source such as an uninterruptible power supply (not shown) to power bi-directional effector 30 and a programmable electronic controller 34. Bi-directional effector 30 may be a Model BDPG-60-80-24V-3000-R18 brush DC planetary gearmotor from Anaheim Automation Inc. located in Anaheim, Calif. Controller 34 may be Model MC038-010 PLUS+1 controller available from Danfoss, an international engineering company headquartered in Nordborg, Denmark. The power source may be located in a ceiling above frame 20 or in a wall next to apparatus 10; location and configuration of the power supply may be dictated by building codes related to fire protection and other considerations. Drive mechanism 28, slide plate 52, and controller 34 are configured to enable door 14 to be continuously closed but not locked when a continuously-closed signal is received by controller 34.

Figure 5:
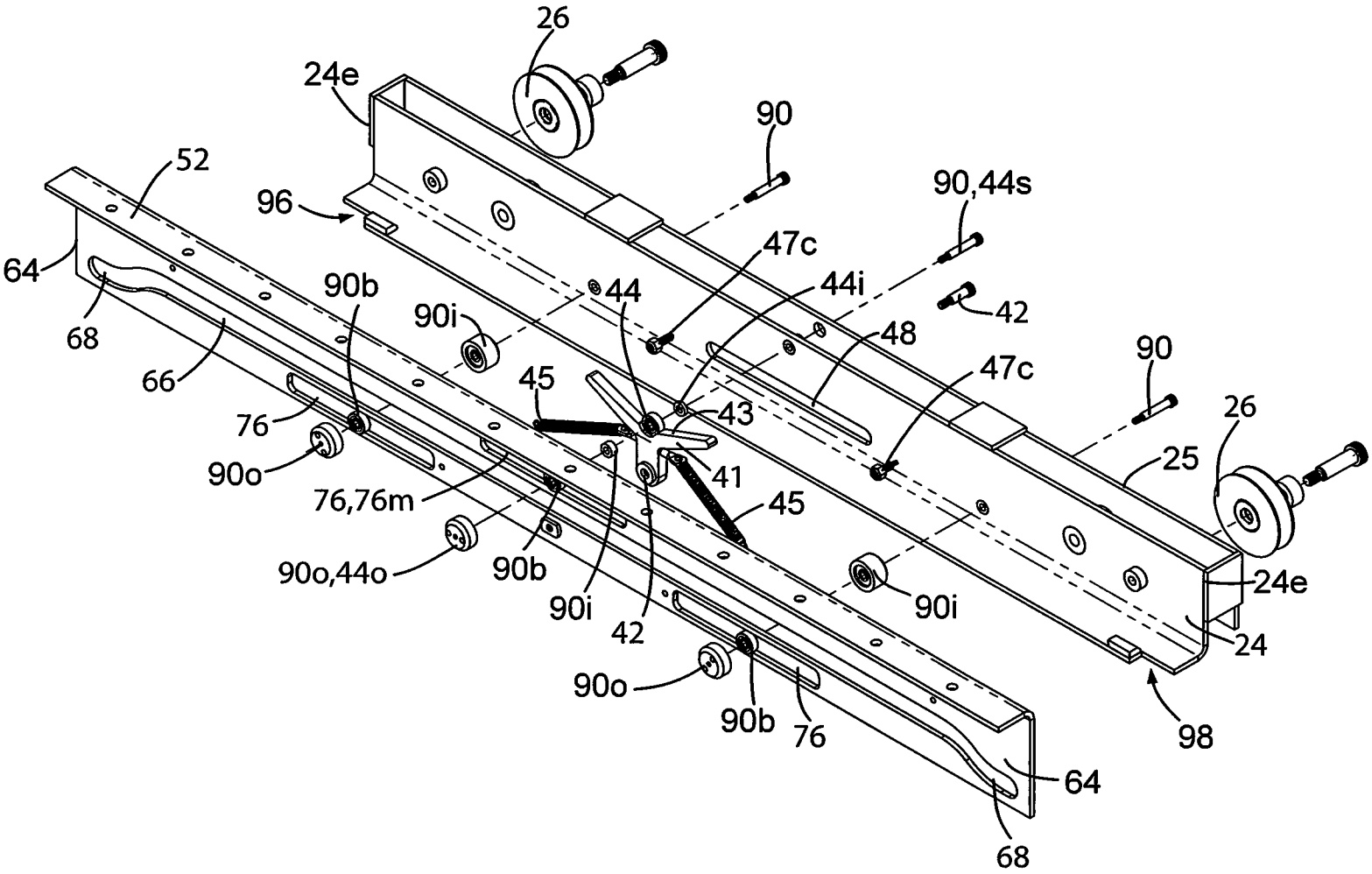
FIG. 5 is an exploded-view perspective drawing of the centering apparatus, carriage, and slide plate of the mechanism of the sliding-door embodiment of FIG. 1.
Figure 5A:
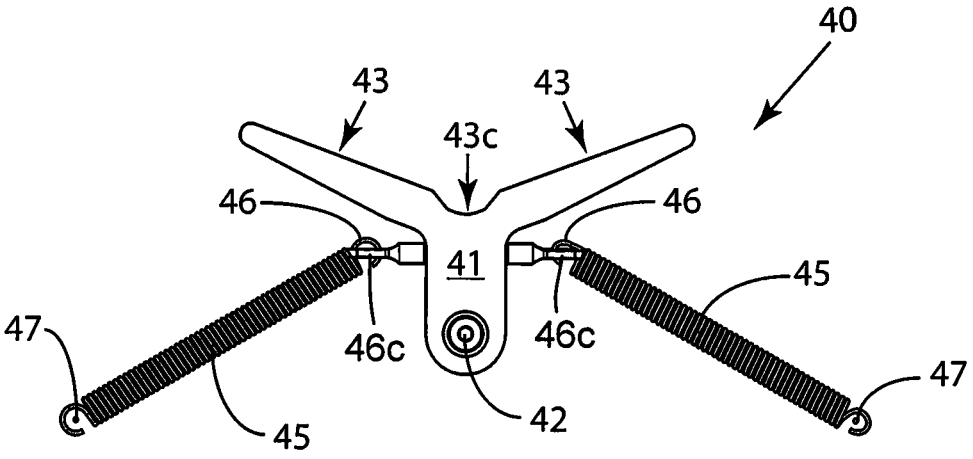
FIG. 5A is a front-elevation drawing of the yoke and related parts of the centering apparatus of the sliding-door embodiment of FIG. 1.
Figure 5B:
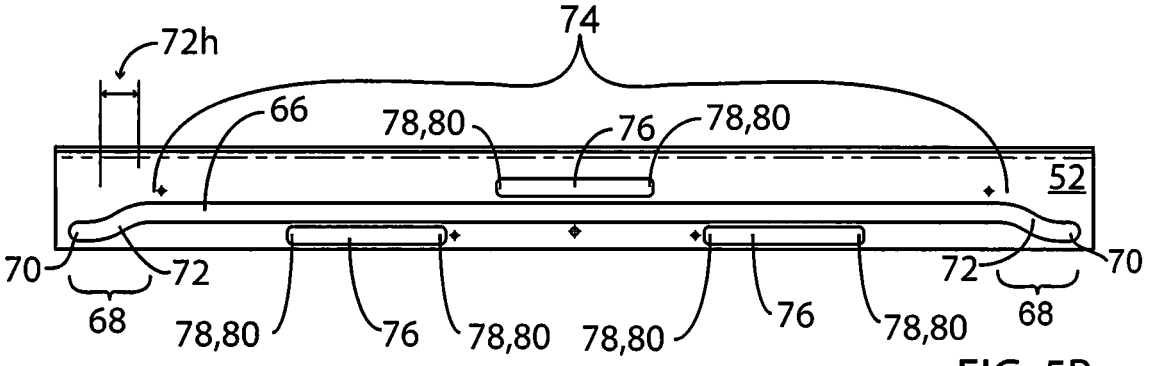
FIG. 5B is a front-elevation drawing of the slide plate of the mechanism of the sliding-door embodiment of FIG. 1.
Figure 5C:
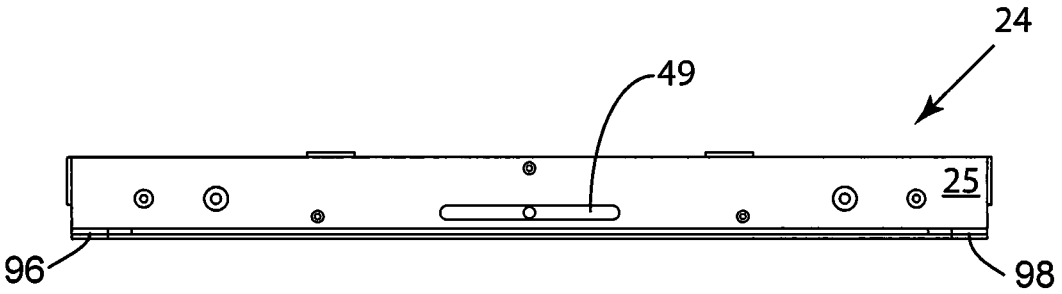
FIG. 5C is a front-elevation drawing of the carriage of the mechanism of the sliding-door embodiment of FIG. 1.

Sliding-door apparatus 10 includes mechanical centering apparatus 40 which is described in much of the text which follows. FIGS. 5 through 5C illustrate certain components of sliding-door apparatus 10 in more detail, and in particular, mechanical centering apparatus 40. FIG. 5 is an exploded-view perspective drawing of centering apparatus 40, carriage 24, and slide plate 52 of the mechanism of sliding-door apparatus 10. FIG. 5B is a front-elevation drawing of slide plate 52, and FIG. 5C is a front-elevation drawing of carriage 24. Mechanical centering apparatus 40 includes a yoke 41, a yoke pivot 42, and two springs 45 as shown in the front-elevation drawing of FIG. 5A; these elements of centering apparatus 40 will be described later in this document.

Referring to FIGS. 5, 5B and 5C, slide plate 52 includes a cam slot 66 parallel to the direction of opening and closing movement of door 14 and spanning slide plate 52 between two slide-plate end sections 64. FIGS. 7 through 11 also illustrate in detail that cam slot 66 has a slot end 68 in each of end sections 64. Slot ends 68 each include an end portion 70, the two end portions 70 being positioned between and below a spanning portion 74 of cam slot 66. Each slot end 68 also has a ramp portion 72 connecting each end portion 70 with its corresponding ramp portion 72 such that cam slot 66 is a continuous slot between the two slot ends 68 (and end portions 70).

Referring primarily to FIG. 5B, slide plate 52 also includes three limit slots 76 parallel to cam slot 66. One such limit slot 76 is also referred to as a middle limit slot 76*m* and will be described further below. Each limit slot 76 has a lock-limit end 78 at each end 80 of limit slot 76 and has a length at least as long as the length of end portions 70 plus the horizontal length 72*h* of ramp portions 72. Carriage 24 of sliding-door apparatus 10 includes three limit pins 90 each engaging its corresponding limit slot 76. Limit slots 76 and limit pins 90 serve to limit the relative movement of slide plate 52 with respect to carriage 24 (and thus door 14) when slide plate 52 is driven into a locked-open or locked-closed position at end sections 64. (See FIGS. 10 and 11.) Limit slots 76 also provide some driving friction between slide plate 52 and carriage 24 to drive door 14. Limit pins 90 each support a limit-pin bearing 90*b* which contacts its corresponding limit slot 76. Each limit pin 90 also supports a limit-pin outer portion 90*o* and a limit-pin inner portion 90*i* between which their corresponding limit-pin bearing 90*b* is held.

Sliding-door apparatus 10 also includes a position sensor 36 (see FIGS. 3 and 4A) for sensing position of slide plate 52 relative to frame 20 and providing such position information to controller 34. In embodiment 10, position sensor 36 is a draw wire encoder spanning nearly the entire length of frame 20. Position sensor 36 may be a Model TC5.3502.A112 linear measurement draw wire encoder available from Hans Turck GmbH & Co. KG headquartered in North Rhine-Westphalia, Germany. Controller 34, which may receive door-state commands from a central location such as a facility security control room (not shown), is programmed with four setpoints which are numerical values representing four positions of slide plate 52 relative to frame 20, sensed by position sensor 36 along the span of travel of slide plate 52. These four setpoints represent slide-plate 52 positions corresponding to locked-closed (for normal operation), locked-open (for normal operation), unlocked-closed (for emergency operation), and unlocked-open (for emergency operation); such setpoints also correspond to operational states of door 14. (Another operational state of door 14 can be thought of as door 14 moving toward either a closed or open position.)

Figure 6:
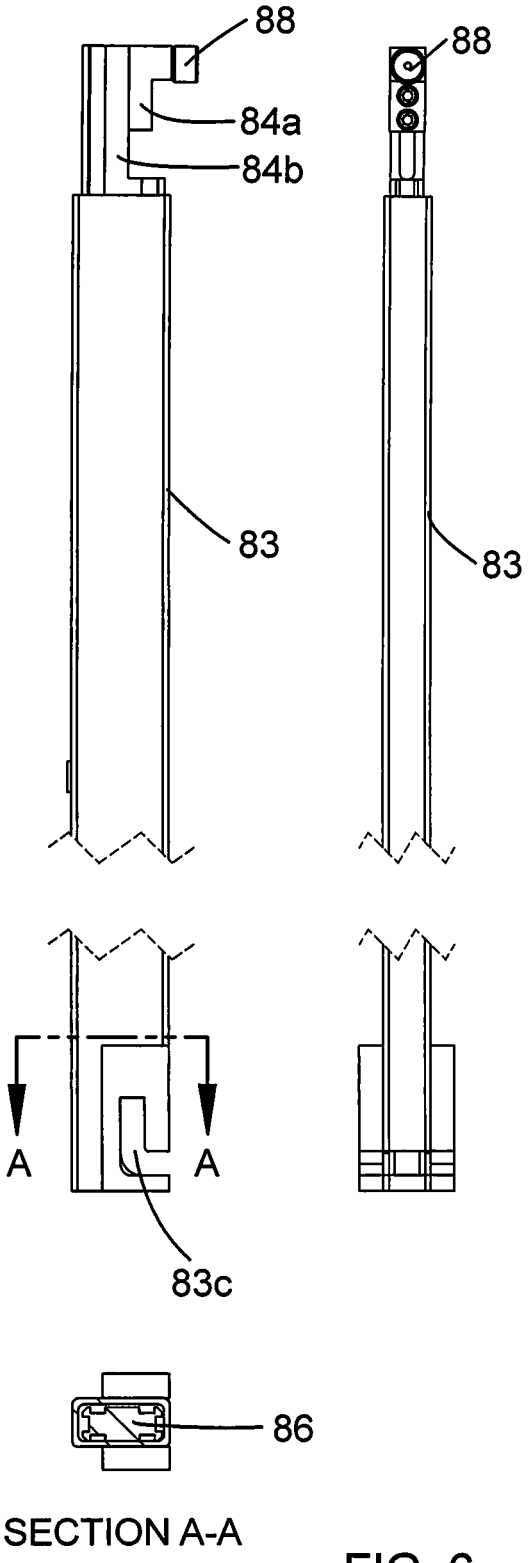
FIG. 6 is a three-view drawing of the lock bar of the sliding-door mechanism embodiment of FIG. 1 with the lock bar mounted within its lock-bar sheath.
Figure 6A:
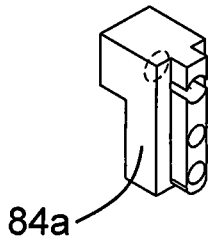
FIG. 6A is a perspective drawing of the deadbolt portion of the lock-bar upper end as shown in FIG. 6.
Figure 6B:
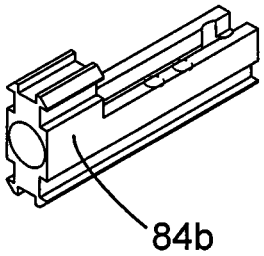
FIG. 6B is a perspective drawing of the base portion of the lock-bar upper end as shown in FIG. 6.
Figure 6C:
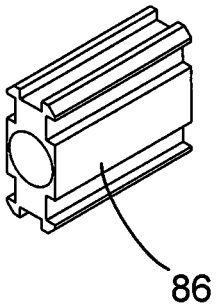
FIG. 6C is a perspective drawing of the deadbolt portion of the lock-bar lower end as shown in FIG. 6.

As shown in FIGS. 3 and 6 through 6C, sliding-door apparatus 10 includes a vertical lock bar 82 which is slidably (vertically) secured to frame 20 and includes an upper end 84, a lower end 86 and a lock-bar cam follower 88 secured to upper end 84 of lock bar 82 and configured to engage cam slot 66. Upper end 84 includes a lock-bar upper-end deadbolt 84*a* and a lock-bar upper-end base 84*b*. Lock-bar upper-end base 84*b* connects to lock bar 82, and lock-bar upper-end deadbolt 84*a* is attached to lock-bar upper-end base 84*b*. Lock bar 82 also includes a lower-bar lower end 86. Vertical lock bar 82 travels in a sheath 83 mounted in frame 20. Vertical lock bar 82 may be made of pipe or solid bar stock. In the particular configuration of embodiment 10, the outer shapes of upper end 84 and lower end 86 are formed merely to provide clearance around internal welds on the inside surface of sheath 83.

Referring to FIGS. 7-11, sliding-door apparatus 10 includes a door bottom guide 14*b* which has a lower-locked-open notch 92 and a lower-locked-closed notch 94. Door bottom guide 14*b* is configured such that lower-locked-open notch 92 receives lower end 86 (serves as a deadbolt) of lock bar 82 when door 14 is in a locked-open position and lower-locked-closed notch 94 receives lower end 86 (serves as a deadbolt) of lock bar 82 when door 14 is in a locked-closed position. Referring to FIGS. 5 and 5C, carriage 24 includes an upper-locked-open notch 96 and an upper-locked-closed notch 98. Upper-locked-open notch 96 and upper-locked-closed notch 98 are configured such that upper-locked-open notch 96 receives upper-end deadbolt 84*a* of lock bar 82 when door 14 is in a locked-open position and upper-locked-closed notch 98 receives upper-end deadbolt 84*a* of lock bar 82 when door 14 is in a locked-closed position. As shown in FIGS. 1-3, 4A and 6, lock-bar sheath 83 includes a cutout 83*c* which is configured to provide clearance for door bottom guide 14*b* to move through as door 14 is moved.

Cam follower 88 follows cam slot 66 as slide plate 52 moves. In normal operation, when door 14 is moved to a locked-open or locked-closed position, bi-directional effector 30 drives slide plate 52 such that slide plate 52 moves to a position in which cam follower 88 is in an end portion 70 of one of the end sections 64, past its corresponding ramp portion 72. Such action moves cam follower 88 down which lowers lock bar 82, causing lower end 86 of lock bar 82 to engage either lower-locked-open notch 92 or a lower-locked-closed notch 94 depending on the specific open or closed command. In addition, the same lowering action of lock bar 82 causes upper end 84 of lock bar 82 to engage either upper-locked-open notch 96 or upper-locked-closed notch 98. This action of lock bar 82 locks door 14, and the fact that manual efforts to move door 14 cannot move slide plate 52 means that in normal operation, door 14 is securely locked in either an open or closed position. In such locked positions, door 14 cannot be moved by normal human intervening forces such as pushing, pulling, prying, or other similar physical activities.

Sliding-door apparatus 10, with the functions of vertical lock bar 82, may be a security barrier which can be one of multiple security barriers in a criminal detention or similar type facility. In normal operation, its primary purpose is to open or close door 14 to a selectable desired position (door state) by a command signal from an external command source such as a facility security control room. Controller 34 receives the desired command and controls the movement of slide plate 52 in the proper direction until a desired, predetermined position is achieved. Controller 34 may also make position information of door 14 available to other devices to ensure that other controllers or devices which may be connected to controller 34 have the door-state of door 14.

Referring again to FIGS. 1-3, frame 20 includes a receiver assembly 21. In addition to receiving door 14 in closed positions, receiver assembly 21 includes a key switch 14*k* accessible from both sides of door 14 to enable opening of door 14 without controller 34 receiving a signal from a facility security control room. Receiver assembly 21 also includes an intercom 38 available on both sides of door 14 and an emergency release system 14*e* to enable opening of door 14 manually if necessary. Emergency release system 14*e* may be accessed with a key. As shown, door 14 also includes a handle 14*h*.

In normal operation, aside from movement between open and closed positions, door 14 is either in a locked-closed state in order to prevent passage through door 14 or a locked-open state in order to permit passage through door 14. In these two operational states, door 14 remains in such a state until another control signal is received by controller 34 to change the operational state of door 14.

Emergency operation of sliding-door apparatus 10 is defined as the operational condition occurring when life safety is the overriding concern and human passage through door 14 is necessary. In addition, however, it is also important in emergency operation that door 14 be in a closed position when not being used for human passage in order to prevent passage of fire and/or smoke through door 14. In such emergency operation, door 14 is in an unlocked-closed position in order to permit manual opening of door 14 to an unlocked-open position for human passage through door 14. This operation of door 14 is known as continuously-closed operation and is set by controller 34 sending a continuously-closed signal to apparatus 10. Thus, in addition to door 14 being able to be opened manually, controller 34 is configured to close door 14 when no manual closing force is being applied to door 14. In embodiment 10, controller 34 is also configured to assist the manual opening of door 14 even though the manual force required for opening door 14 is not excessive. Door 14 remains in a continuously-closed state until another control signal is received by controller 34 to change the operational state of door 14.

As mentioned above, FIGS. 5 through 5C illustrate mechanical centering apparatus 40 by which inventive sliding-door apparatus 10 with passive deadlock prevention enables door 14 to be continuously closed but not locked when a continuously-closed signal is received by controller 34. Mechanical centering apparatus 40 causes the required relative positioning of slide plate 52 and carriage 24 to achieve the continuously-closed performance of door 14. Mechanical centering apparatus 40 keeps door 14 substantially centered on slide plate 52 unless slide plate 52 is driven by motor 30 such that one of the slide-plate end sections 64 is placed into a locked-open or locked-closed position.

Referring to FIGS. 5-5C, mechanical centering apparatus 40 includes yoke 41 pivotably attached to slide plate 52 at yoke pivot 42 which includes a pin also labeled in FIG. 5 with reference number 42. Carriage 24 includes a clearance slot 48 for yoke pivot 42. Yoke 41 includes a yoke cam surface 43 above yoke pivot 42. Centering apparatus 40 also includes a yoke-cam follower 44 attached to carriage 24 and following yoke cam surface 43, and two springs 45 having proximal ends 46 attached to yoke 41 at proximal-end connections 46*c* spaced above yoke pivot 42 and distal ends 47 each attached to carriage 24 at distal-end connections 47*c* offset from yoke pivot 42 in opposite lateral directions.

Yoke cam follower 44 includes a yoke-cam-follower bearing 44*b*, a yoke-cam-follower outer portion 44*o* and a yoke-cam-follower inner portion 44*i*, all of which are supported on a yoke-cam-follower shaft 44*s* by which yoke cam follower 44 is attached to carriage 24. Yoke-cam-follower bearing 44*b* is the component of yoke cam follower 44 which contacts yoke cam surface 43. Yoke-cam-follower shaft 44*s* also supports a limit-pin bearing 90*b* and is thus also referred to as limit pin 90. Such limit-pin bearing 90*b* contacts middle limit slot 76*m* as described above. Thus, yoke-cam-follower outer portion 44*o* also serves as limit-pin outer portion 90*o* for limit pin 90 in middle limit slot 76*m*.

Figure 7:
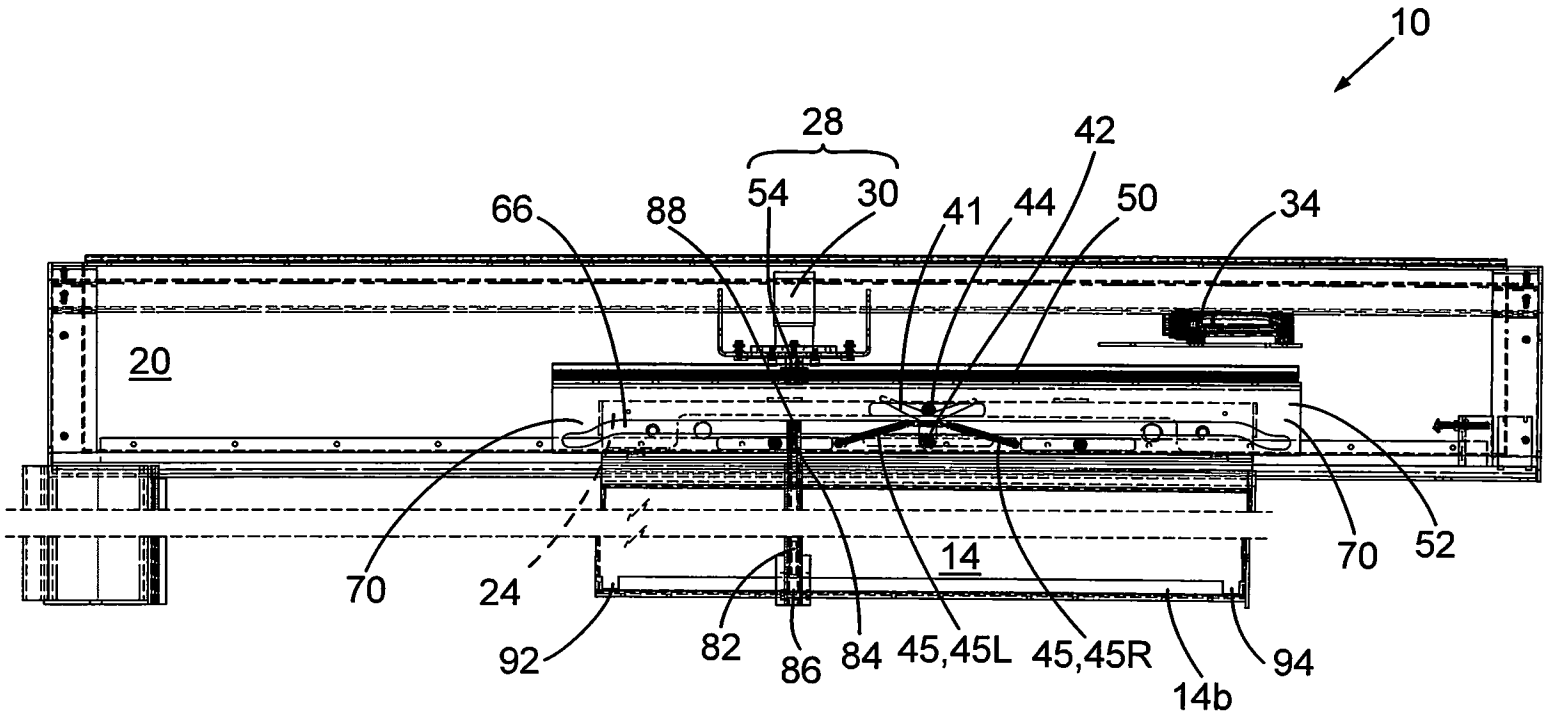
FIG. 7 is a full-width rear-elevation drawing of the embodiment of the sliding-door apparatus of FIG. 1 with the door in a middle position.

One of the most significant characteristics of centering apparatus 40 is that it is fully passive (unpowered); centering apparatus 40 includes only simple mechanical components in a novel structure to achieve the deadlock-prevention function required by code for a sliding security door with life safety performance. Sliding door 14 is driven by the relative motion of slide plate 52 with respect to carriage 24. FIG. 7 is a full-width rear-elevation drawing sliding-door apparatus 10 with door 14 in a middle position.

In FIGS. 7 through 11, springs 45 are also labeled 45L and 45R for left and right, respectively, as viewed from the back of embodiment 10. As described above, yoke 41 is pivotably attached to slide plate 52 by yoke pivot 42, and springs 45L and 45R are attached to slide plate 52 (at proximal ends 46 and proximal connection points 46*c*) and carriage 24 (at distal ends 47 and distal connection points 47*c*) as described above. When motor 30 drives slide plate 52 to the right (in FIGS. 7 through 11), the inertia of door 14 and carriage 24 causes carriage 24 to lag behind slide plate 52, which causes yoke-cam follower 44 to move to the left relative to yoke pivot 42, thereby tilting yoke 41 to the left. Such tilting motion of yoke 41 extends spring 45R. Such extension of spring 45R creates a pulling force to move carriage 24 to the right. There are also some drag forces between slide plate 52 and carriage 24, transmitted from limit slots 76 to carriage 24 through limit-pin bearings 90*b*, which also move carriage 24 to the right as slide plate 52 is moved to the right. The spring force of spring 45R causes carriage 24 to catch up (or nearly catch up) to slide plate 52 as the motion of slide plate 52 reaches a constant speed. (Motion to the left occurs in a similar fashion.)

When the motion of slide plate 52 (to the right) is slowed and eventually stops as controlled by controller 34, for a brief period of time, the inertia of door 14 and carriage 24 causes carriage 24 to move ahead (to the right) of slide plate 52 which, in a similar fashion to the above description, causes the extension of spring 45L which then slows carriage 24 and eventually pulls carriage 24 back to a yoke center position relative to slide plate 52, at a cam-surface center 43*c*. Thus, mechanical centering apparatus 40 operates to control the relative position of carriage 24 with respect to slide plate 52. Most importantly, mechanical centering apparatus 40 prevents carriage 24 from moving due to inertia into a locked position (so-called "deadlock") at either end of carriage 24 travel when slide plate 52 is itself not driven into such a position.

FIGS. 8-11 are a set of enlarged rear-elevation drawings similar to FIG. 7, but in each such drawing, frame 20 is broken at one end or the other in order to enlarge the other components to show more clearly the relative movement/positions of slide plate 52, carriage 24 and door 14, the upper end 84 of lock bar 82, and positions of the components of mechanical centering apparatus 40 in four operational states of sliding-door apparatus 10. In FIGS. 8-11, carriage 24 and its reference number line is shown as dotted because it is behind slide plate 52. A number of objects in the drawings are also shown in this fashion.

Figure 8:
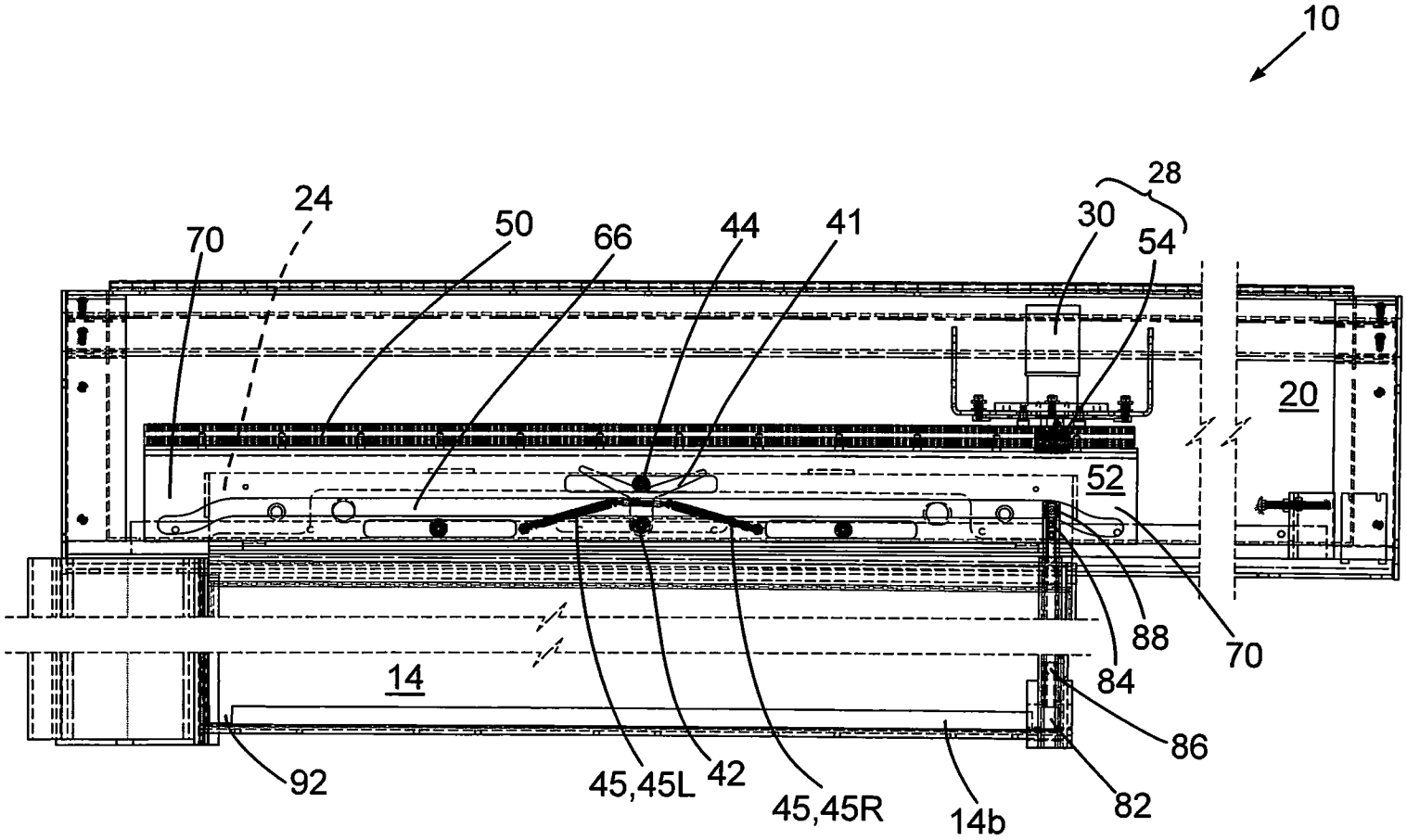
FIGS. 8 through 11 are a set of enlarged rear-elevation drawings of the mechanism of the sliding-door embodiment of FIG. 1 illustrating the relative positions of the slide plate, the carriage and door, the upper end of the lock bar, and positions of the components of the mechanical centering apparatus in four operational states of the embodiment of the sliding-door apparatus of FIG. 1.
Figure 9:
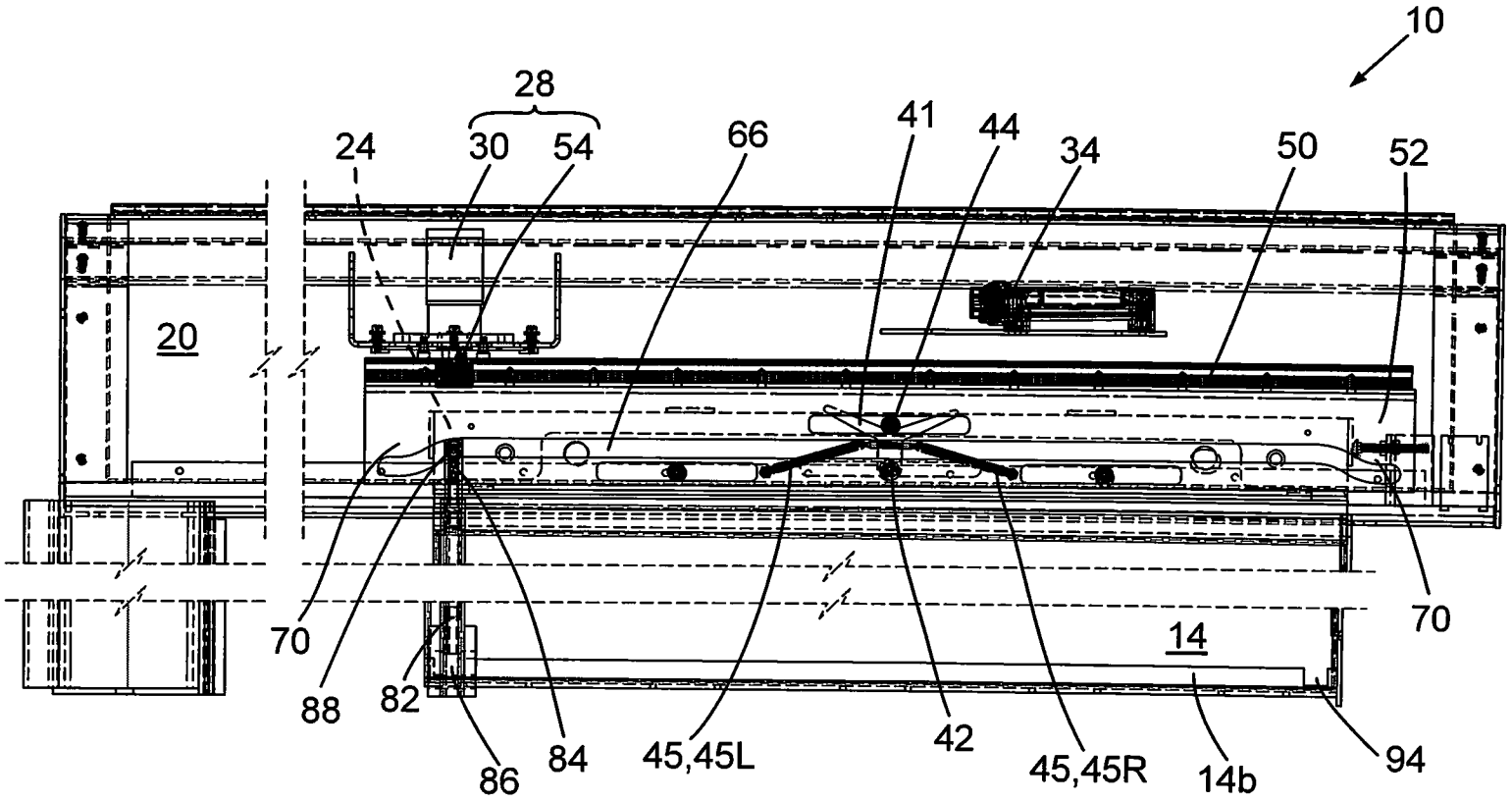

FIG. 8 illustrates the sliding-door mechanism of FIG. 7 with door 14 in an unlocked-closed position during emergency operation, and FIG. 9 illustrates the sliding-door mechanism of FIG. 7 with door 14 in an unlocked-open position during emergency operation. During emergency operation, in the unlocked-closed position of FIG. 8 and the unlocked-open position of FIG. 9, lock bar 82 is in a raised position since lock bar cam follower 88 in cam slot 66 is not in any part of either slot end 68. Also in these two figures, carriage 24 is centered on slide plate 52 with neither spring 45L nor spring 45R in an extended state. When door 14 is in the unlocked-closed state, door 14 remains closed but unlocked to prevent the passage of smoke and the like through door 14. However, controller 34 is programmed such that a small manually-caused displacement of door 14 toward being opened causes programmable controller 34 to move slide plate 52 to its unlocked-open position, thereby causing door 14, as described above, to open to permit the passage of a person during emergency operation. Controller 34 is further programmed to move door 14 back to its unlocked-closed position after a preset period of time in the unlocked-open position to again prevent passage of smoke.

Bi-directional effector 30 may be back-drivable, i.e., carriage 24 and door 14 may be movable while no power is supplied to effector 30. In unlocked states of door 14 in embodiment 10 in which bi-directional effector 30 is electric motor 30, the force required to back-drive motor 30 is about 20 pounds. In other words, any attempt to move door 14 manually into a locked position would require a force greater than about 20 pounds, but when such force is released, signals from programmable controller 34 cause slide plate 52 to be driven back out of a manually-caused locked position and back into its desired unlocked-closed position.

Figure 10:
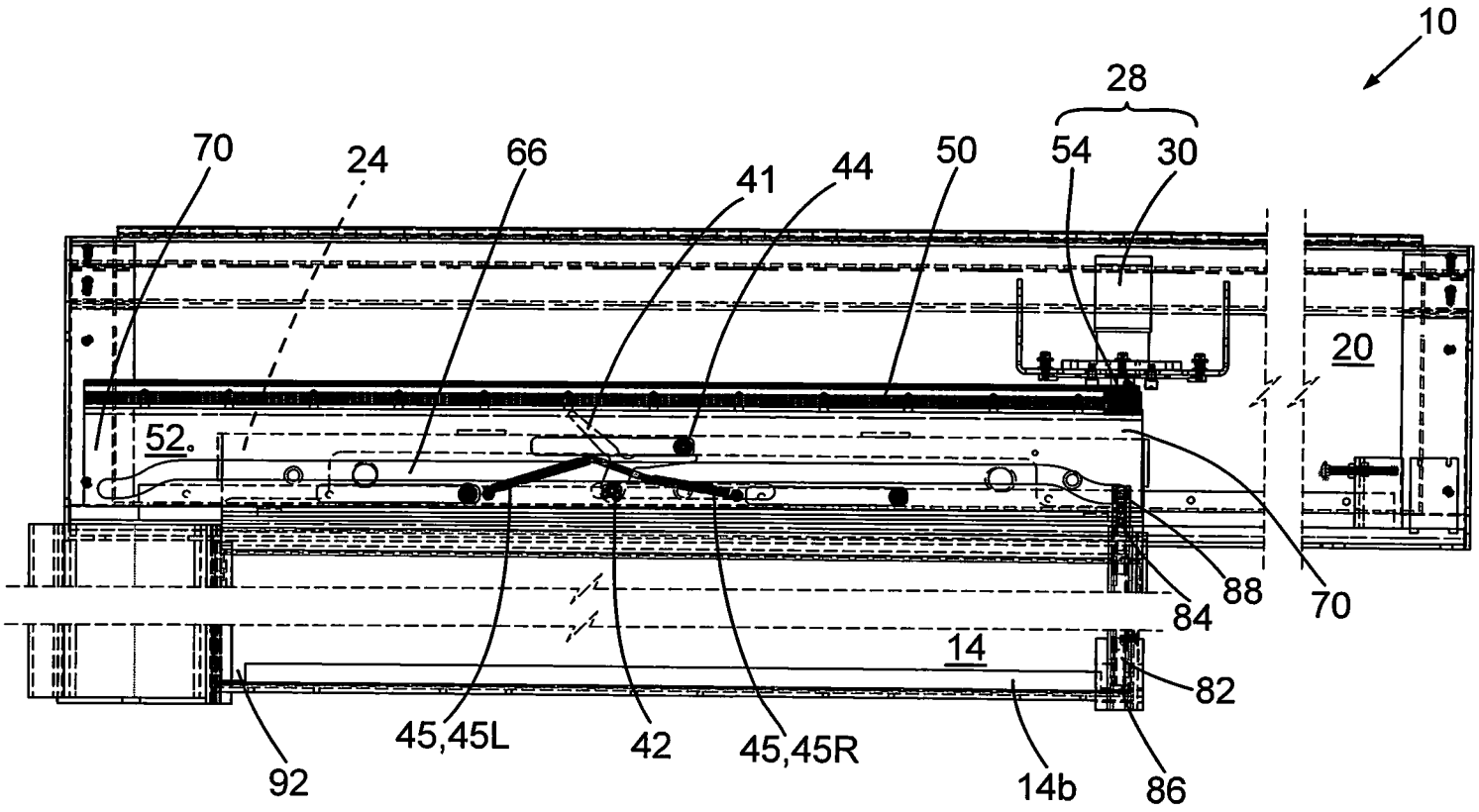
Figure 11:
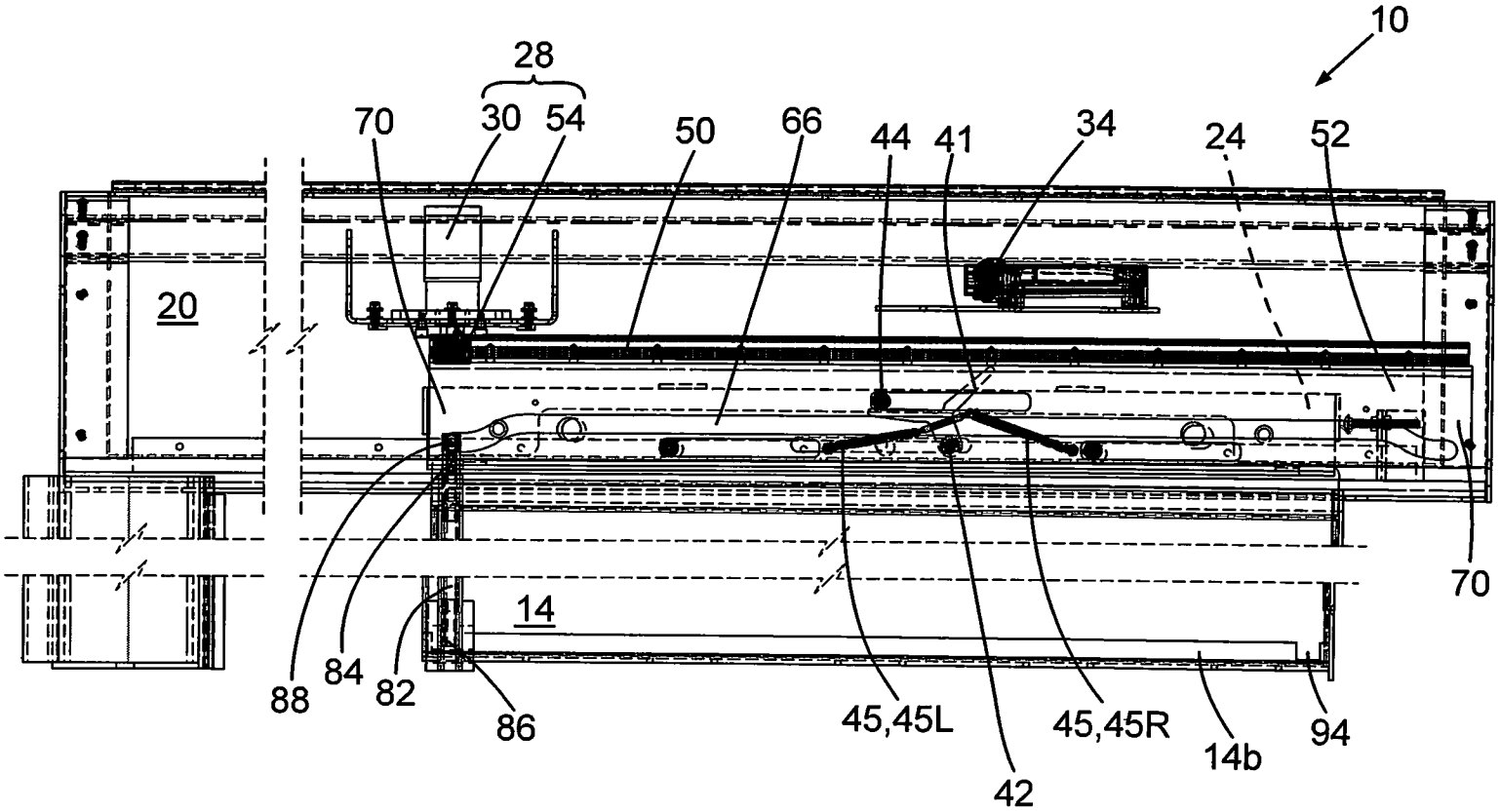

FIG. 10 illustrates sliding-door apparatus 10 with door 14 in a locked-closed position during normal operation, and FIG. 11 illustrates sliding-door apparatus 10 with door 14 in a locked-open position during normal operation. In each of these two normal-operation positions, depending on door 14 being open or closed, corresponding slot end 68 allows its corresponding end portion 70 of slide plate 52 to move beyond its corresponding carriage end 24*e* of carriage 24 in order to lock door 14. In each of these two positions, lock bar 82 is in a lowered position since lock-bar cam follower 88 in cam slot 66 is in an end portion 70. Because lock bar 82 locks door 14 in these positions, any attempt to manually-displace door 14 is ineffective in moving slide plate 52, and door 14 remains locked until controller 34 directs motor 30 to move slide plate 52. Of course, in either such locked position, either spring 45L or spring 45R is extended and pulls on slide plate 52 to attempt to center it with respect to carriage 24. Both springs 45 are configured such that the maximum force produced by springs 45 is less than the minimum back-driving force required by bi-directional effector 30.

While the principles of this invention have been described in connection with specific embodiments, it should be understood clearly that these descriptions are made only by way of example and are not intended to limit the scope of the invention. Numerous other effector/drive mechanism combinations may be adapted to drive door 14 to achieve the desired movement of the inventive sliding-door apparatus. For example, in other embodiments, bi-directional effector 30 may be a different type of effector such as a pneumatic or hydraulic motor or cylinder or a linear electric actuator. Such alternative bi-directional effectors may be used with various mechanical elements to produce the linear motion of slide plate 52.

The invention claimed is:

1. In a high-security sliding-door apparatus for closing and opening a passage in a wall, a door having: (a) a door frame having a door-supporting track and a bi-directional effector; (b) a carriage secured to a door top edge and having track-engaging rollers; (c) a slide plate (i) slidably secured to the carriage, (ii) driven by the effector, and (iii) having two end sections; and (d) a controller controlling slide-plate movement and configured to enable the door to be continuously closed but not locked when a continuously-closed signal is received by the controller, the improvement comprising mechanical centering apparatus for relative positioning of the slide plate and carriage, the centering apparatus including:

a yoke pivotably attached to the slide plate at a yoke pivot and having a yoke cam surface thereabove;

a yoke-cam follower attached to the carriage and following the cam surface; and a pair of springs having proximal ends attached to the yoke spaced above the yoke pivot and distal ends each attached to the carriage at points offset from the yoke pivot in opposite lateral directions, whereby the door is kept substantially centered on the slide plate unless a slide-plate end section is driven to a locked-open or locked-closed position.

2. The sliding-door apparatus of claim 1 wherein the controller is a programmable electronic controller.

3. The sliding-door apparatus of claim 1 wherein the effector is an electric motor and the slide plate includes a rack driven by a pinion on the motor.

4. The sliding-door apparatus of claim 3 wherein the controller is a programmable electronic controller.

5. The sliding-door apparatus of claim 4 further including a position sensor for sensing position of the slide plate relative to the frame.

6. The sliding-door apparatus of claim 5 wherein:

the slide plate includes a cam slot parallel to the direction of the door opening and closing movement and spanning the slide plate between the two end sections, the cam slot having a slot end in each of the end sections, the slot ends each including an end portion positioned below a spanning portion of the cam slot and a ramp portion connecting each end portion with its corresponding ramp portion such that the cam slot is a continuous slot between the two end portions;

a vertical lock bar is slidably secured to the frame and has an upper end, a lower end, and a cam follower secured to the upper end of the lock bar and configured to engage the cam slot; and the sliding-door apparatus includes a lower-locked-open notch and a lower-locked-closed notch both fixed with respect to the door and configured such that the lower-locked-open notch receives the lower end of the lock bar when the door is in the locked-open position and the lower-locked-closed notch receives the lower end of the lock bar when the door is in the locked-closed position.

7. The sliding-door apparatus of claim 6 further including an upper-locked-open notch and an upper-locked-closed notch both fixed with respect to the door and configured such that the upper-locked-open notch receives the upper end of the lock bar when the door is in the locked-open position and the upper-locked-closed notch receives the upper end of the lock bar when the door is in the locked-closed position.

* * * * *